US012590704B2

(12) United States Patent
Parnell et al.

(10) Patent No.: US 12,590,704 B2
(45) Date of Patent: Mar. 31, 2026

(54) WOOD STOVE

(71) Applicants: Stephen Patrick Parnell, Daito (JP); Satomi Parnell, Daito (JP)

(72) Inventors: Stephen Patrick Parnell, Daito (JP); Satomi Parnell, Daito (JP)

(73) Assignee: Satomi Parnell, Daito (JP)

( * ) Notice: Subject to any disclaimer, the term of this patent is extended or adjusted under 35 U.S.C. 154(b) by 381 days.

(21) Appl. No.: 18/473,285

(22) Filed: Sep. 25, 2023

(65) Prior Publication Data

US 2024/0102660 A1 Mar. 28, 2024

(30) Foreign Application Priority Data

Sep. 28, 2022 (JP) ..... 2022-154331

(51) Int. Cl.
*F24B 1/20* (2006.01)
*F24B 13/04* (2006.01)

(52) U.S. Cl.
CPC ..... *F24B 1/20* (2013.01); *F24B 13/04* (2013.01)

(58) Field of Classification Search
CPC ..... F24B 1/20; F24B 13/04
USPC ..... 126/21 R
See application file for complete search history.

(56) References Cited

U.S. PATENT DOCUMENTS 2,300,486 A * 11/1942 Cargile ..... F24B 5/08 126/10
3,882,767 A * 5/1975 Oyler ..... A21B 1/24 126/21 R
4,368,721 A * 1/1983 Kroupa ..... F24B 5/023 126/76
4,485,797 A * 12/1984 D'Alessandro ..... F24B 1/20 126/6
4,630,592 A * 12/1986 Larabie ..... F24B 7/04 126/72
4,989,521 A * 2/1991 Traeger ..... F23B 1/38 110/118
2001/0037803 A1* 11/2001 Perrault ..... F24B 1/02 126/77
2011/0017190 A1* 1/2011 Cardenas Silva ..... F24B 13/04 110/286

(Continued)

FOREIGN PATENT DOCUMENTS

JP 2019-27743 A 2/2019
JP 2022-52746 A 4/2022

*Primary Examiner* — Avinash A Savani
(74) *Attorney, Agent, or Firm* — Yokoi & Co., U.S.A.; Toshiyuki Yokoi

(57) ABSTRACT

To provide a wood stove that is enabled for utilizing combustion heat to cook food. A wood stove 10 comprises: a box-shaped main-body part 12 having an interior space for discharging through a discharge section, smoke generated in burning a combustible fed through a feeding section 24; and a box-shaped oven part 18 stacked on the main-body part 12 and having an interior space for utilizing combustion heat conducted from the main-body part 12 to cook food; the main-body part 12 having a combustion chamber 14 and an exhaust chamber 16 sectioned by a partition wall 15 disposed in a central portion, and the partition wall 15 having a communication hole section 15*a* formed on the other side of the combustion chamber 14 for making the combustion chamber 14 and the exhaust chamber 16 communicate with each other.

3 Claims, 5 Drawing Sheets

(56) References Cited

U.S. PATENT DOCUMENTS

2015/0292746 A1* 10/2015 Bowers ..... F24B 1/02
126/77
2017/0215641 A1* 8/2017 DeBruler ..... A47J 37/0763

* cited by examiner

WOOD STOVE

CROSS-REFERENCES TO RELATED APPLICATIONS

This patent specification is based on Japanese patent application, No. 2022-154331 filed on Sep. 28, 2022 in the Japan Patent Office, the entire contents of which are incorporated by reference herein.

TECHNICAL FIELD

The present invention relates to a wood stove.

BACKGROUND ART

In recent years, wood stoves have become popular due to the camping boom and other factors. As technology related to the present invention, for example, Patent Document 1 discloses an assembly type stove comprising: a primary combustion chamber having on one end thereof, a feed opening through which a combustible is fed, and on the other end thereof, a coupling opening; a frame that supports the primary combustion chamber in a state of floating from an installation surface; and a secondary combustion chamber provided detachably from/reattachably into the coupling opening of the primary combustion chamber, and while communicating with the primary combustion chamber, provided perpendicular to the longitudinal direction of the primary combustion chamber; wherein in the interior of the primary combustion chamber, provided is a first air supply duct having a first open end that extends along the longitudinal direction, that is furnished with a plurality of air holes, and that has an opening on the feed-opening side, and a first closed end the coupling-opening side of which is closed, and in the interior of the primary combustion chamber and the secondary combustion chamber, provided is a second air supply duct having a second open end that extends from the primary combustion chamber along the longitudinal direction of the secondary combustion chamber, that is furnished with a plurality of air holes, and that is open on the lower-end side thereof via the base side of the primary combustion chamber, and a second closed end the upper-end side of which is closed.

Furthermore, Patent Document 2 discloses a portable outdoor wood stove including a furnace main body and a telescopic chimney assembly, wherein the furnace main body has a furnace for burning firewood, and has a through-hole on one end of the upper section of the furnace main body, the through-hole being connected to the furnace, and wherein the telescopic chimney assembly includes a chimney base and a conic-trapezoid tapered telescopic chimney, the tapered telescopic chimney being fixedly connected to the inner wall of the chimney base, and linked to the furnace in order to discharge smoke.

RELATED ART DOCUMENTS

Patent Documents

Patent Document 1: JP 2019-027743 A
Patent Document 2: JP 2022-052746 A

SUMMARY OF THE INVENTION

Problem to be Solved by the Invention

Patent Documents 1 and 2 disclose wood stoves and the like, which can provide warmth by burning combustion materials inside the stove, but the oven function to utilize this combustion heat to cook food is not disclosed in Patent Documents 1 and 2.

The objective of the present invention is to provide a wood stove that is enabled for utilizing combustion heat to cook food.

Means for Solving the Problems

A wood stove according to the present invention comprises: a box-shaped main-body part having an interior space for discharging through a discharge section, smoke generated in burning a combustible fed through a feeding section; and a box-shaped oven part stacked on the main-body part and having an interior space for utilizing combustion heat conducted from the main-body part to cook food; the main-body part having a combustion chamber and an exhaust chamber sectioned by a partition wall disposed in a central portion, the combustion chamber having a combustion-chamber-side flow path for channeling primary-combustion air taken in from one side where the feeding section is provided to another side, the partition wall having a communication hole section formed on the other side of the combustion chamber to allow the combustion chamber and the exhaust chamber to communicate with each other, and the exhaust chamber having an exhaust-chamber-side flow path for channeling smoke taken in through the communication hole section disposed on the one side in a direction opposite to the air flow, toward the other side where the discharge section is provided.

Furthermore, in the wood stove according to the present invention, it is preferable that the main-body part and the oven part are separable.

Furthermore, it is preferable that the wood stove according to the present invention comprises a hopper part that is fitted into the feeding section to feed firewood.

Effects of the Invention

The present invention is enabled for utilizing combustion heat in a wood stove to cook food.

DESCRIPTION OF EMBODIMENT

Figure 1:
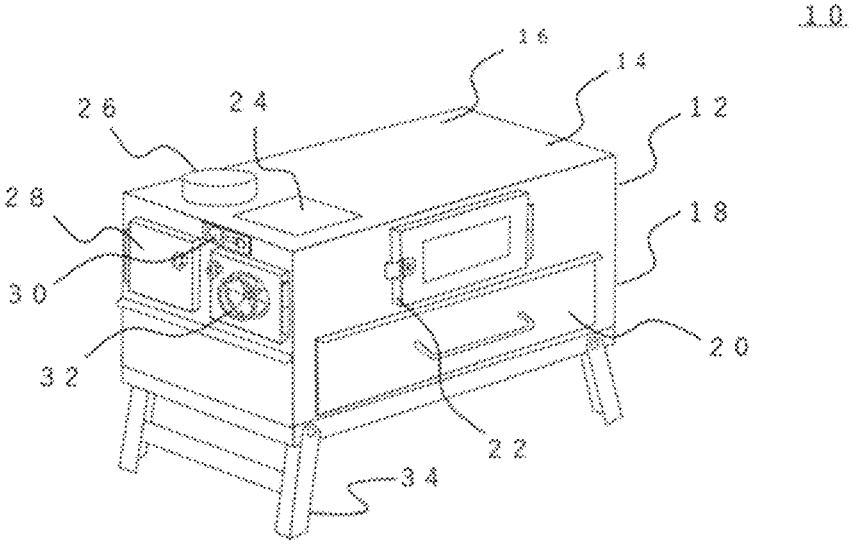
FIG. 1 is a diagram illustrating a wood stove according to an embodiment of the present invention.

Hereinafter, a mode of embodying the present invention is explained in detail with reference to the accompanying drawings. In the following, like elements are assigned the same reference numerals in all the figures in the drawings, and a repeated description is omitted. In addition, in the description in the text, the reference numerals mentioned previously are used if necessary.

Figure 2:
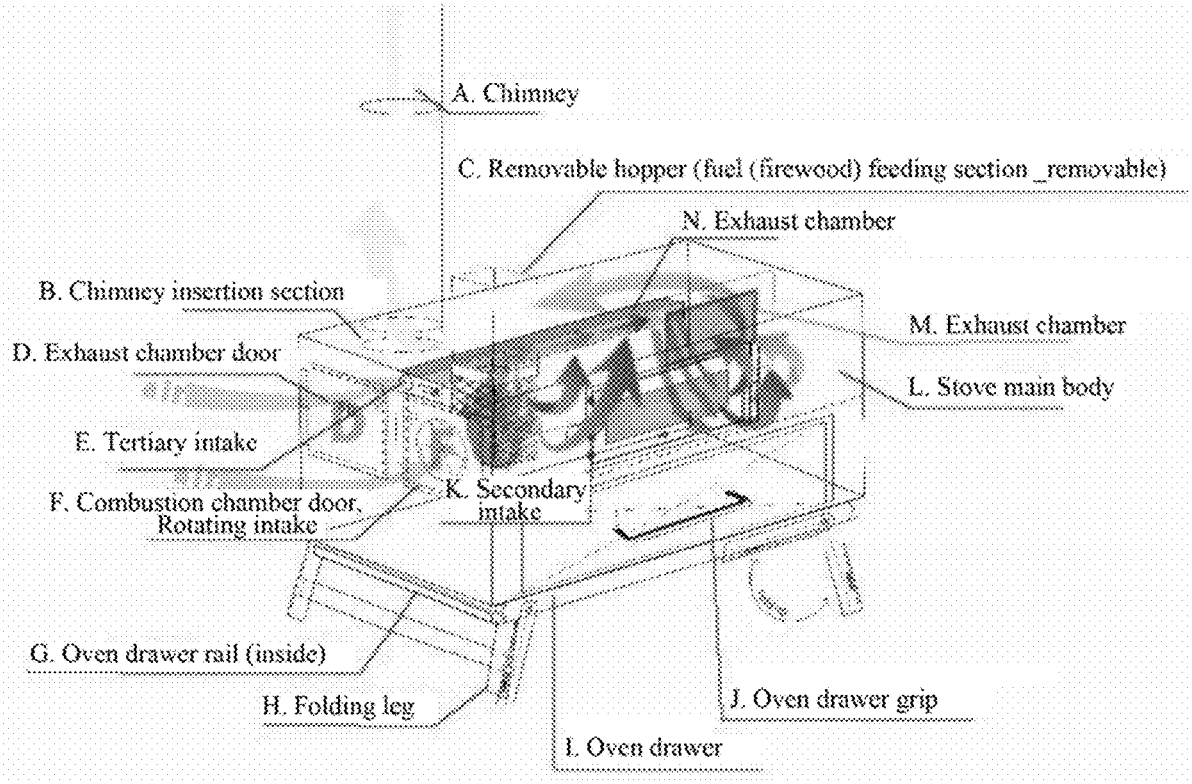
FIG. 2 is a diagram illustrating the flow of air and smoke in the wood stove according to the embodiment of the present invention.

FIG. 1 is a diagram illustrating a wood stove 10 according to an embodiment of the present invention. FIG. 2 is a diagram illustrating the flow of air and smoke in the wood stove 10 according to the embodiment of the present invention.

Figure 3A:
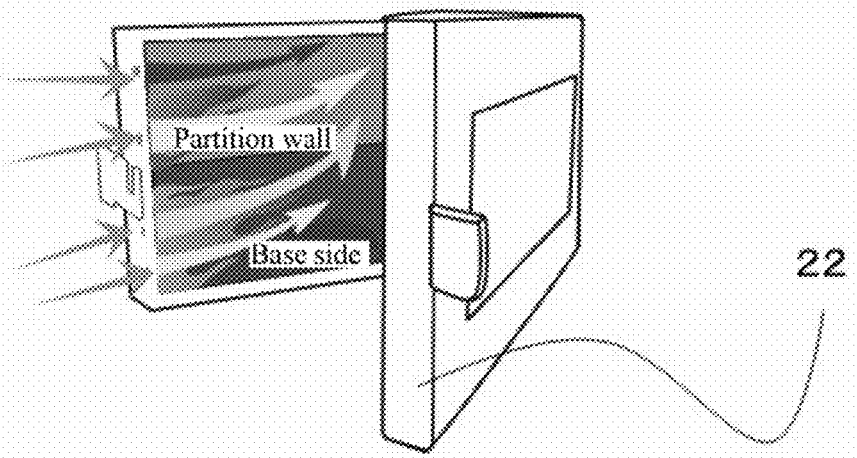
FIGS. 3A to 3C are views illustrating opening and closing of an opening/closing door for taking in secondary-combustion air in the wood stove according to the embodiment of the present invention.
Figure 3B:
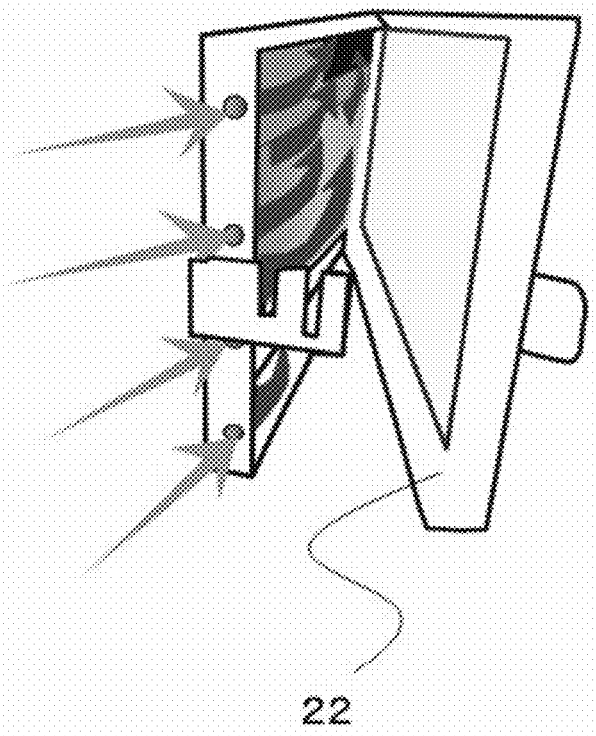
Figure 3C:
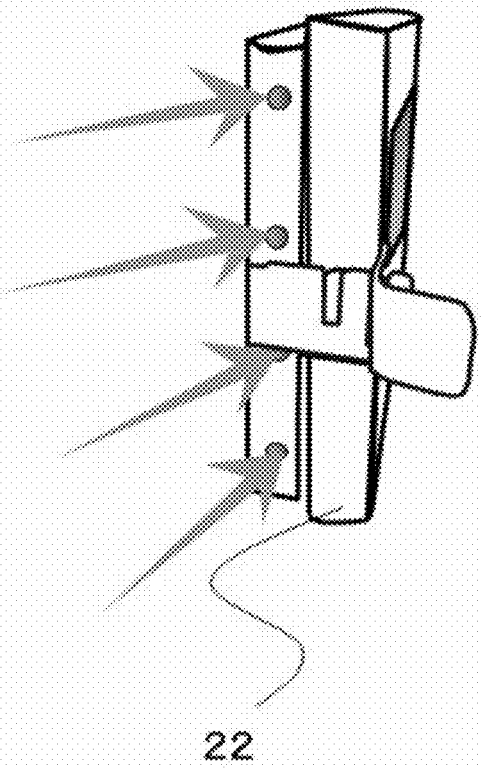
Figure 4A:
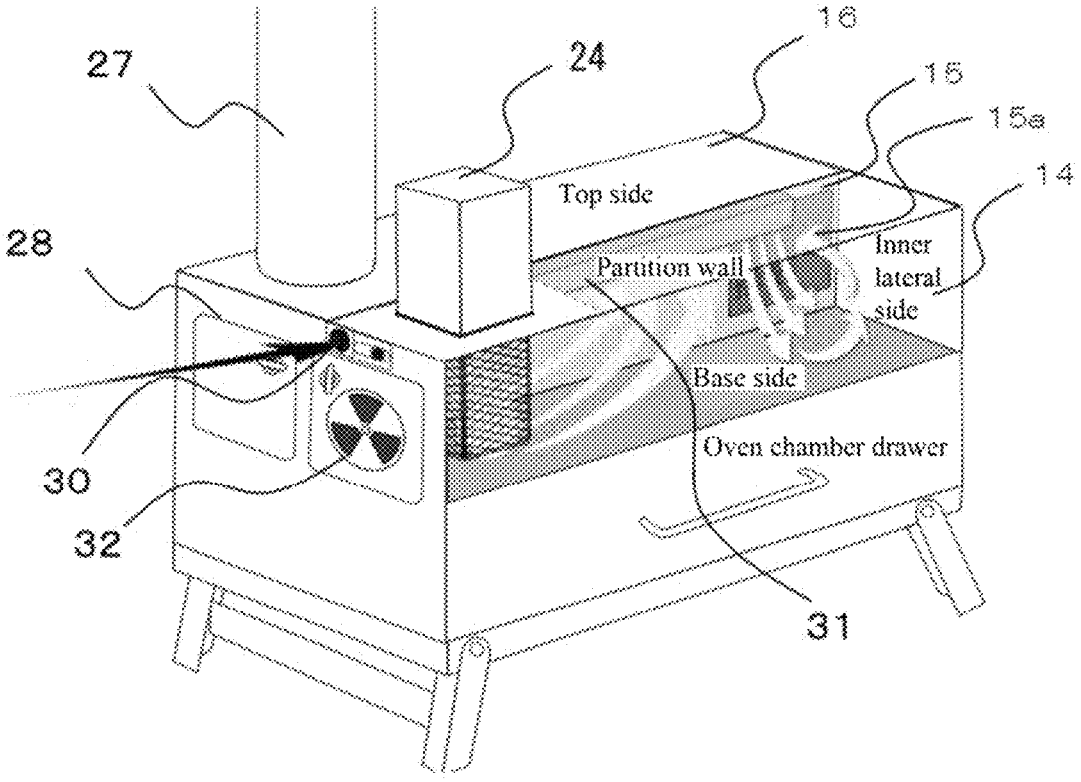
FIGS. 4A and 4B are views illustrating intake of tertiary-combustion air to carry out tertiary combustion in the wood stove according to the embodiment of the present invention.
Figure 4B:
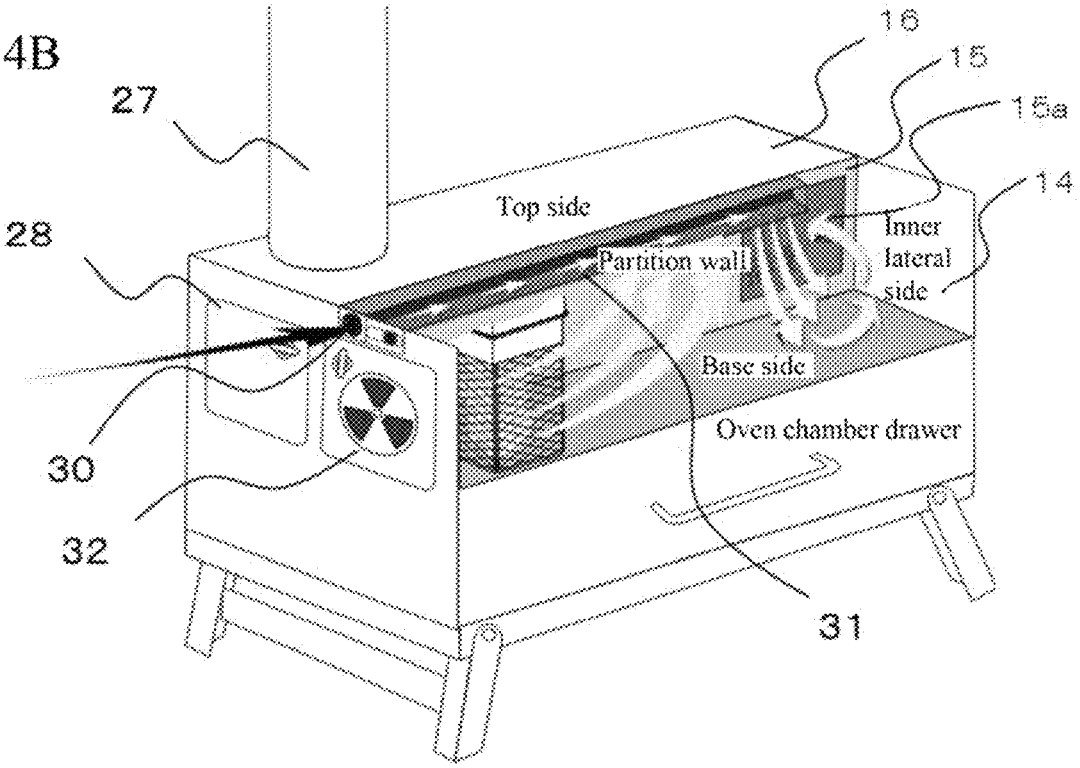

FIGS. 3A to 3C are views illustrating opening and closing of an opening/closing door 22 for taking in secondary-combustion air in the wood stove 10 according to the embodiment of the present invention. FIGS. 4A and 4B are views illustrating intake of tertiary-combustion air to carry out tertiary combustion in the wood stove 10 according to the embodiment of the present invention.

Figure 5A:
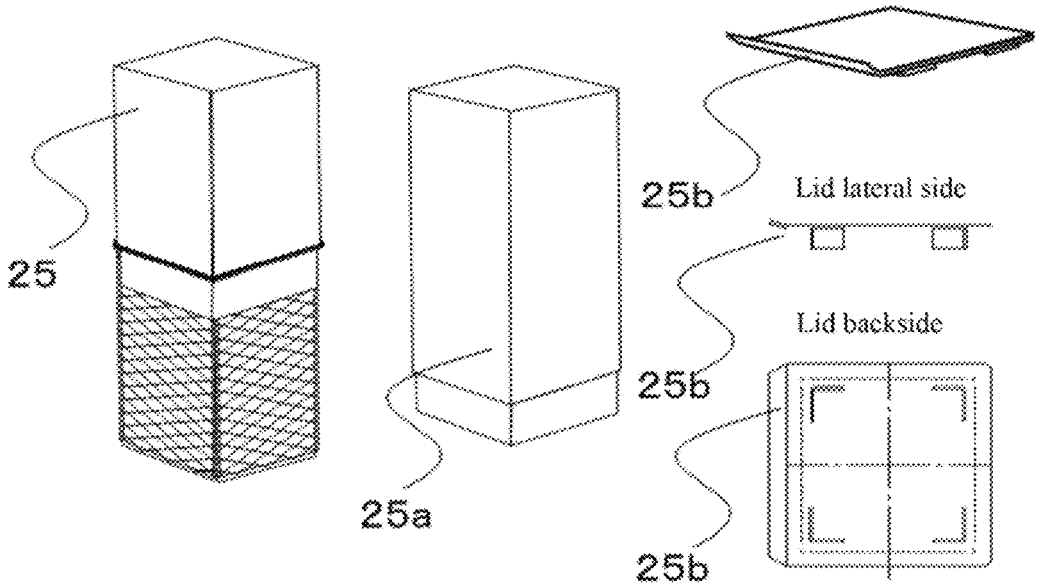
FIGS. 5A and 5B are views illustrating a hopper part that can be fitted into a feeding section in the wood stove according to the embodiment of the present invention.
Figure 5B:
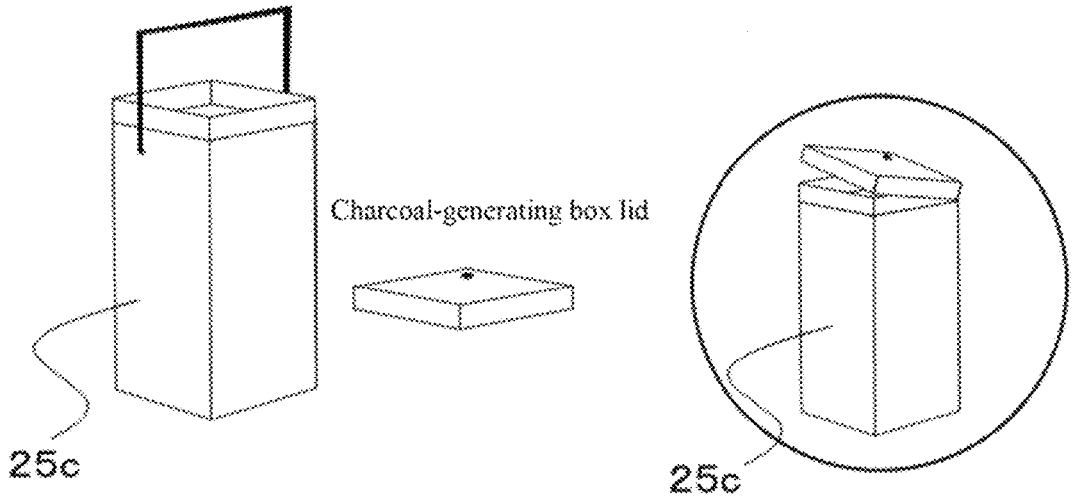

FIGS. 5A and 5B are views illustrating a hopper part 25 that can be fitted into a feeding section 24 in the wood stove 10 according to the embodiment of the present invention.

The wood stove 10 comprise: a box-shaped main-body part 12; a box-shaped oven part 18; the hopper part 25; a chimney part 27; and a leg part 34. The wood stove 10 has the functions of providing warmth by burning combustibles and of utilizing the combustion heat to cook food. Herein, the main-body part 12, the oven part 18, and the leg part 34 are separable from each other.

The main-body part 12 has an interior space for discharging smoke generated by burning combustibles fed from the feeding section 24 through the discharge section 26. The main-body part 12 is a box member constituted by six sides including: a ceiling side; a base side; a front side; a back side; a left lateral side; and a right lateral side.

The feeding section 24 is a substantially square through-hole, formed in the ceiling side, into which the hopper part 25 can be fitted. The discharge section 26 is a substantially circular through-hole, formed in the ceiling side and adjoining the feeding section 24, into which the chimney part 27 can be fitted.

The feeding section 24 is described as a through-hole having a substantially square shape of 10 cm×10 cm, but the size and the shape can be changed as required.

The hopper part 25 has a square pole shape that can fit into the feeding section 24. The hopper part 25 is described as being constituted by a material having appropriate strength, such as iron, which of course can be changed as required.

As illustrated in FIGS. 5A and 5B, the hopper part 25 has an upper section surrounded by a wall part having an opening in the ceiling side, and has a lower section formed of a mesh-like member, the base side of which is meshed to allow for the accommodation (support) of combustibles (firewood). As illustrated in FIGS. 2 and 4, the mesh-like member in the lower section of the hopper part 25 is inserted into a combustion chamber 14 when fitted to the feeding section 24.

The hopper part 25 enables stable combustion with a small amount of firewood and has the effect of reducing fuel consumption. Here, the hopper part 25 is described as of a substantially square shape of 10 cm×10 cm in plan view and 23 cm in height in side view, but of course that can be changed as required. Since conventional wood stoves do not have the hopper part 25, it is necessary to feed firewood directly into the maintenance combustion chamber, which results in rapid combustion of firewood and use of a lot of firewood.

The hopper part 25 comprises a lid part 25*b* that is fitted to the opening on the ceiling side so that combustibles burn well when a fuel material is fed in and the combustibles are ignited. The hopper part 25 may also have an extension hopper 25*a* fitted into the opening on the ceiling side.

As illustrated in FIG. 5B, it is also possible that charcoal be generated by using an encapsulated charcoal-generating box 25*c* with the hopper part 25 inserted inside.

The main-body part 12 has the combustion chamber 14 and an exhaust chamber 16 sectioned by a partition wall 15 disposed in a central portion.

Preferably, the main-body part 12 is constituted by a material having appropriate strength, an example of which may be iron. For the combustibles, firewood is employed for description here, but of course wooden pellets, wood chips, etc. may also be employed.

The main-body part 12 is described, for example, as having a lengthwise (horizontal) dimension of 50 cm, a depthwise (vertical) dimension of 30 cm, and a height of 15 cm, but of course this can be changed as required.

The combustion chamber 14 has a combustion-chamber-side flow path for primary-combustion air taken in from one side, where the feeding section 24 is provided, to flow to the other side.

Primary-combustion air is taken in through a combustion chamber door 32, which is provided on the left lateral side of the main-body part 12 (the one side of the combustion chamber 14). The combustion chamber door 32 can be opened and closed by utilizing a hinge, and has a mechanism that allows the amount of air taken in to be adjusted by turning the handle. The interior of the combustion chamber 14 can be accessed by opening the combustion chamber door 32, and the interior of the combustion chamber 14 can accommodate the removed chimney part 27, for example, or other items. The combustion chamber door 32 can also be opened for directly feeding firewood, and ash produced when this firewood is burnt can be removed by opening the combustion chamber door 32.

The combustion chamber door 32 is described as a door having a size of 10 cm×10 cm, which of course can be changed as required. The primary-combustion air taken in through the combustion chamber door 32 is the gas required for the combustibles to burn vigorously, and the smoke formed by burning the combustibles flows toward the other side.

The combustion chamber 14 has the opening/closing door 22 that can be opened and closed to take in secondary-combustion air in the central portion of the combustion-chamber-side flow path.

The opening/closing door 22, provided in the central portion on the front side of the main-body part 12 as illustrated in FIG. 1, has a transparent part (heat-resistant glass) for viewing the combustion in the combustion chamber 14. The opening/closing door 22 can be opened and closed using a hinge, etc., and the amount of air taken in for secondary combustion can be adjusted by means of the opening angle.

The opening/closing door 22 is described as a door having a size of 10 cm×20 cm, which of course can be changed as required.

As illustrated in FIGS. 3A to 3C, the opening/closing door 22 is provided with a catch part having a plurality of recesses, and by hooking onto any of the recesses, the opening angle can be adjusted. The opening/closing door 22, provided with four through-holes, can be rendered to allow secondary-combustion air to be taken in only through the four through-holes even when it is brought close to the fully closed state, as illustrated in FIG. 3C.

The secondary-combustion air taken in by opening the opening/closing door 22 mixes with smoke flowing in the combustion chamber 14 and causes further ignition, thus causing secondary combustion.

The combustion chamber 14 is described, for example, as having a lengthwise (horizontal) dimension of 50 cm, a depthwise (vertical) dimension of 15 cm, and a height of 15 cm, but of course this can be changed as required.

The partition wall 15, as illustrated in FIGS. 4A and 4B, is a wall member that is disposed in the central portion to divide the main-body part into two parts. The partition wall 15 has a communication hole section 15*a* formed on the other side of the combustion chamber 14 to allow the combustion chamber 14 and the exhaust chamber 16 to communicate with each other.

The communication hole section 15*a* is an inlet that smoothly and efficiently leads the smoke from the combustion chamber 14 into the exhaust chamber 16, and the smoke taken into the exhaust chamber 16 flows to the chimney part 27 to be discharged. The communication hole section 15*a* is described here as a square of 10 cm×10 cm, but the size, of course, can be changed as required, and the shape can also be circular.

The exhaust chamber 16 has an exhaust-chamber-side flow path to channel the smoke taken in through the communication hole section 15*a*, which is disposed on the one side, in the direction opposite to the air flow, toward the other side where the discharge section 26 is provided. The exhaust heat generated in the combustion chamber 14 flows through the communication hole section 15*a* into the exhaust chamber 16, serving to maintain the temperature of the oven part 18.

The exhaust chamber 16 is described, for example, as having a lengthwise (horizontal) dimension of 50 cm, a depthwise (vertical) dimension of 15 cm, and a height of 15 cm, but of course this can be changed as required.

The discharge section 26 is a through-hole with an inner diameter of 10 cm that serves as an insertion section for the chimney. After being inserted into the discharge section 26, the chimney part 27 can be secured using a chimney fittings or the like.

Provided on the other side of the exhaust chamber 16 (left lateral side of the main-body part 12) is an exhaust chamber door 28. The exhaust chamber door 28 can be opened and closed by utilizing a hinge. The interior of the exhaust chamber 16 can be accessed by opening the exhaust chamber door 28, and the interior of the exhaust chamber 16 can accommodate the removed chimney part 27, for example, or other items.

The exhaust chamber door 28 is described as a door having a size of 10 cm×10 cm, which of course can be changed as required. Furthermore, the exhaust chamber door 28 has a removable structure.

The chimney part 27 is a chimney that can be fitted into the discharge section 26. The chimney part 27 is constituted by stainless steel. The chimney part 27 is described as a chimney having an inner diameter of 10 cm×height of 45.5 cm, which of course can be changed as required.

The oven part 18 is stacked on the main-body part 12, and has an interior space for cooking food using combustion heat conducted from the main-body part 12. The oven part 18 can be slid to access the interior space by pulling a drawer grip provided on the front side.

The heat conducted from the interior of the combustion chamber 14 can heat the oven interior to approximately 230° C., allowing a user to enjoy a pizza, bread, a dish by Dutch oven cooking, and the like.

The oven grip is removable, sturdy, and set up for easy gripping even with leather gloves on. The oven grip can be constituted by a variety of materials, and can be constituted by walnut, for example, to prevent burns when touched with bare hands.

The oven part 18 is described, for example, as having a lengthwise (horizontal) dimension of 50 cm, a depthwise (vertical) dimension of 30 cm, and a height of 15 cm, but of course this can be changed as required.

The extended circulation path 31, having an opening 30 the opening area of which is set small so that air less than the primary-combustion air is taken in, as illustrated in FIGS. 4A and 4B, is a cylindrical flow path that, in order to discharge tertiary-combustion air taken in through the opening 30 near the communication hole section 15*a*, is extended so as to circulate the tertiary-combustion air.

The extended circulation path 31 is provided in the substantially central portion on the ceiling side (upper side) of the main-body part 12 and has a substantially square pole shape that is disposed along the combustion chamber 14 side. The extended circulation path 31 circulates tertiary-combustion air taken in through the opening 30 located on the upstream side, and discharges the tertiary-combustion air through a plurality of small holes provided on the downstream side to the communication hole section 15*a*.

The tertiary-combustion air taken in through the opening 30 flows downstream while being heated to a high temperature as the combustion heat in the combustion chamber 14 is conducted to the extended circulation path 31. The heated air is then discharged through small holes downstream, and thus flows at an increased velocity and mixes vigorously with the smoke in the combustion chamber, which causes tertiary combustion. The tertiary-combustion air then flows through the communication hole section 15*a* into the exhaust chamber 16.

The leg part 34 is provided with a tabular support part that supports the oven part 18 and four foldable legs that extend downward from this support part. The leg part 34 can be made compact when the four legs are closed to fit onto the support part.

The operation of the wood stove 10 in the above configuration will now be explained. In the wood stove 10, the hopper part 25 is fitted into the feeding section 24, and the chimney part 27 is fitted into the discharge section 26. Then, combustibles (firewood) are fed into the hopper part 25 and ignited.

The primary-combustion-side air taken in through the combustion chamber door 32 flows downstream to burn the wood, and smoke flows toward the communication hole section 15*a*. Then, to the smoke that has flowed downstream, secondary-combustion air taken in through the opening/closing door 22 flows downstream and mixes with and ignites the smoke, causing secondary combustion.

The smoke produced in the secondary combustion flows further downstream toward the communication hole section 16. Then, tertiary-combustion air is taken in through the opening 30, and the air that has circulated through the extended circulation path 31 and been discharged through the three through-holes vigorously mixes with the smoke produced by the secondary combustion to cause tertiary combustion.

The smoke produced in the tertiary combustion is directed through the interior of the exhaust chamber 16 to the other side of the combustion chamber 14, and is discharged through the discharge section 26 and chimney part 27 to the outside.

In this way, the wood stove 10, being configured to carry out not only primary and secondary combustion but also tertiary combustion, yields the remarkable effect of more efficient combustion.

The wood stove 10, because of the entire flow of air or smoke produced in combustion in the combustion chamber 14, as well as the smoke through the exhaust chamber 16 forming a substantially U-shape, and because of the feeding section 24 and the discharge section 26 disposed adjoining each other, has an advantage that it can be made compact and can efficiently conduct heat to the oven part 18.

Furthermore, the wood stove 10 has a merit that it allows for cooking by opening the drawer part 20 of the oven part 18 and inserting a pizza and the like.

LIST OF REFERENCE NUMERALS

10 Wood stove, 12 Main-body part, 14 Combustion chamber, 15 Partition wall, 15*a* Communication hole section, 16 Exhaust chamber, 18 Oven part, 20 Drawer part, 22 Opening/closing door, 24 Feeding section, 25 Hopper part, 25*a* Extension hopper, 25*b* Lid part, 25*c* Charcoal-generating box, 26 Discharge section, 27 Chimney part, 28 Exhaust chamber door, 30 Opening, 31 Extended circulation path, 32 Combustion chamber door, 34 Leg part

The invention claimed is:

1. A wood stove comprising:

a box-shaped main-body part having an interior space for discharging through a discharge section, smoke generated in burning a combustible fed through a feeding section; and a box-shaped oven part having an interior space for utilizing combustion heat conducted from the main-body part to cook food;

wherein the main-body part and the oven part are stacked, the main-body part has a combustion chamber and an exhaust chamber sectioned by a partition wall disposed in a central portion, the combustion chamber has a combustion-chamber-side flow path for channeling primary-combustion air taken in from a left lateral side where the feeding section is provided to a right lateral side, the partition wall has a communication hole section formed on the right lateral side of the combustion chamber to allow the combustion chamber and the exhaust chamber to communicate with each other, the exhaust chamber has an exhaust-chamber-side flow path for channeling smoke taken in from through the communication hole section disposed on the right lateral side in a direction opposite to the air flow toward the left lateral side where the discharge section is provided, the combustion chamber and the exhaust chamber have a substantially square pole shape in which in comparison with the areas of a left lateral side and a right lateral side, the respective areas of four sides provided between the left lateral side and the right lateral side are larger, and are disposed adjoining each other on one of the four sides, a combustion chamber door for taking in the primary-combustion air is provided on the left lateral side of the main-body part, an exhaust chamber door for accessing the exhaust chamber interior is provided on the left lateral side of the main-body part, the combustion chamber has an opening/closing door that opens and closes for taking in secondary-combustion air in a central portion of the combustion-chamber-side flow path, the wood stove further comprises an extended circulation path that has an opening the opening area of which is set small so that air less than the primary-combustion air is taken in, and that in order to discharge tertiary-combustion air taken in through the opening near the communication hole section through a small hole, is extended so as to circulate the tertiary-combustion air, and the opening is provided on the left lateral side of the main-body part, and the communication hole section is provided on the right lateral side of the main-body part.

2. The wood stove according to claim 1, wherein the main-body part and the oven part are separable.

3. The wood stove according to claim 1, further comprising:

a hopper part that is fitted into the feeding section to feed firewood, wherein the hopper part has an upper section surrounded by a wall part having an opening in a ceiling side, and a lower section constituted by a mesh part that is inserted into the combustion chamber and is capable of supporting a combustible.

* * * * *